United States Patent [19]

Chu

[11] Patent Number: 5,010,661

[45] Date of Patent: Apr. 30, 1991

[54] UNIDIRECTIONAL AIRFLOW VENTILATING SHOE AND A UNIDIRECTIONAL AIRFLOW VENTILATING INSOLE FOR SHOES

[76] Inventor: Chi-kong Chu, 9/F, Block A, Man Hei Mansion, 2-12 Johston Rd., Wanchi, Hong Kong

[21] Appl. No.: 517,449

[22] Filed: May 2, 1990

Related U.S. Application Data

[63] Continuation of Ser. No. 280,542, Dec. 6, 1988, abandoned.

[30] Foreign Application Priority Data

Dec. 7, 1987 [HK] Hong Kong ..... 87107387

[51] Int. Cl.[5] ..... A43B 7/06; A43B 13/38

[52] U.S. Cl. ..... 36/3 B; 36/3 R; 36/43

[58] Field of Search ..... 36/3 R, 3 A, 3 B, 29, 36/43

[56] References Cited

U.S. PATENT DOCUMENTS

| | | | |
|---|---|---|---|
| 2,741,038 | 4/1956 | Eliassen | 36/3 R |
| 3,225,463 | 12/1965 | Burnham | 36/3 R |
| 3,475,836 | 11/1969 | Brahm | 36/3 B |
| 3,716,930 | 2/1973 | Brahm | 36/3 B |
| 4,215,492 | 8/1980 | Sandmeier | 36/3 B |
| 4,224,746 | 9/1980 | Kim | 36/3 B |
| 4,654,982 | 4/1987 | Lee | 36/3 B |
| 4,760,651 | 8/1988 | Pon-Tzu | 36/3 B |
| 4,776,110 | 10/1988 | Shiang | 36/3 B |

FOREIGN PATENT DOCUMENTS

| | | | |
|---|---|---|---|
| 9186 | of 1897 | United Kingdom | 36/3 R |

*Primary Examiner*—Steven N. Meyers

*Attorney, Agent, or Firm*—Blakely, Sokoloff, Taylor & Zafman

[57] ABSTRACT

A unidirectional airflow ventilating shoe having a ordinary upper and sole. A unidirectional airflow ventilating layer (1) is provided on the sole inside the shoe. The ventilating layer has an compressible cavity (2), air inlet (3), main airflow passage (4), branches (5) and air outlets (6). Fresh air outside the shoe is forcedly unidirectionally sucked into the ventilating layer and blown out to fore part inside the shoe.

To convenience sake, a unidirectional airflow ventilating insole can be made for any kind of shoes. The insole comprise a upper portion (7) and lower portion (8). The structure and shape of the upper portion is the same that of the ventilating layer (1). Lower portion (8) can either form an entirety with upper portion (7), or be an elastic substrate athered to the bottom surface of the upper portion with adhesines. The insole can be used in any kind of shoes and attain the same result as unidirectional airflow ventilating shoes of the present invention.

11 Claims, 2 Drawing Sheets

FIG.1
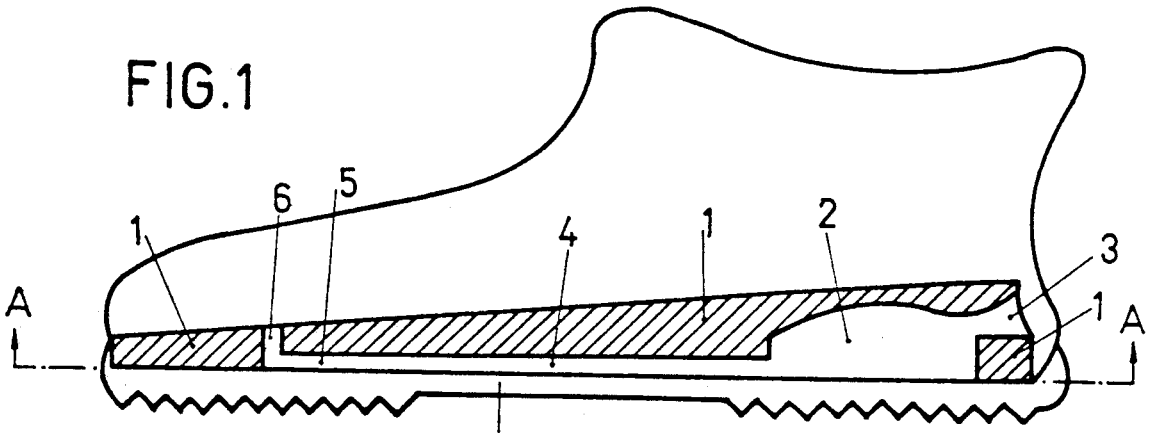
A–A
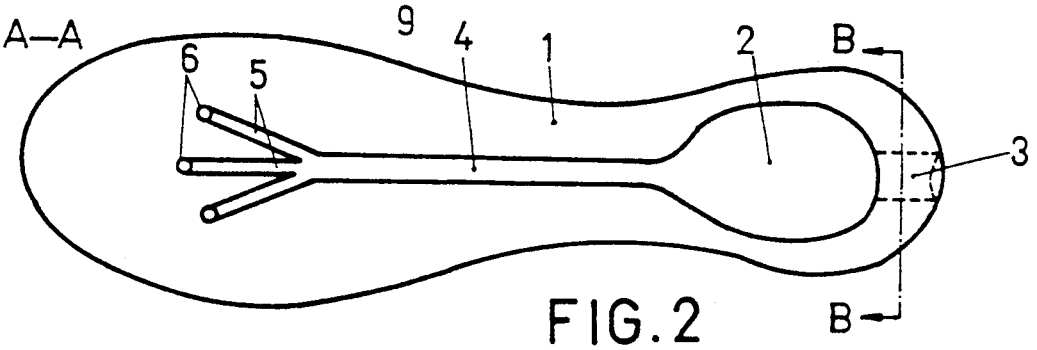
FIG.2
B–B
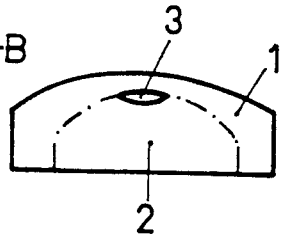
FIG.3
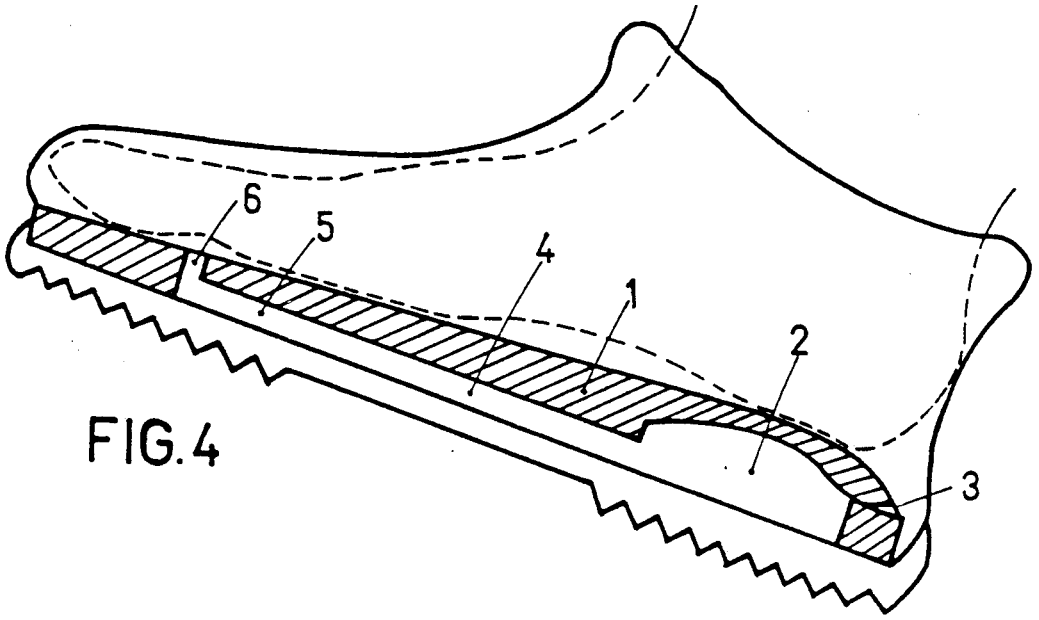
FIG.4

UNIDIRECTIONAL AIRFLOW VENTILATING SHOE AND A UNIDIRECTIONAL AIRFLOW VENTILATING INSOLE FOR SHOES

This is a continuation of application Ser. No. 280,542 filed Dec. 6, 1988, now abandoned.

This invention relates to a kind of shoe, in particular, to a kind of unidirectional airflow ventilating shoe and unidirectional airflow ventilating insole for shoes.

The existing air-blow shoes (FR Nos. 2543803, FR 2548527, DE 3336605 and JP 58-130002) focus on either improving the air permeability or accelerating air permeability by increasing the circulation of air within the shoes. As a result, replacement of fresh air is not possible until the gas in the shoes is discharged and therefore the rate of air permeability is very low. Other kinds of shoes with air-pump, such as DE Nos. 3206631, JP 57-134102, GB 2098851, are better ventilated than the air-blow shoe mentioned above. However, the production process thereof is more complicated due to the adoption of an pump and check valve, and since extra materials are required, the production cost and market price are increased. Moreover, the technique for producing the air-pump shoes is not applicable to casual and sports shoes because the adoption of the pump and valve will make the wearer uncomfortable. Up till now, only one type of such air-pump shoes is manufactured in Taiwan. As metallic spring and ebonite are used for adopting the pump body and valve thereof, only shoes with hard soles of complicated structure and high cost can be manufactured.

The object of the present invention is to provide a kind of unidirectional airflow ventilating shoe and unidirectional airflow ventilating insole for shoes, wherein fresh air outside the shoes is forced unidirectionally into the front part of the feet so as to attain higher rate of ventilation.

As far as the appearance, the sole and the structure of the upper part of the shoes are concerned, there are no difference between the ventilating shoes of the present invention and ordinary shoes. To achieve the object of the invention, there is a unidirectional airflow ventilating layer on the sole inside the shoe. The hell portion of the layer is provided with a compressible cavity at the bottom surface of the layer. The back upper portion of the layer is provided with a elastic closable air inlet and the front portion with a elastic main airflow passage leading to the front part of the layer. The fore end of the main airflow passage is splitted up into several branches. The fore end of each branch is provided with an air outlet leading to the upper surface of the layer.

The present invention will be apparent from the following description, made by way of the example with reference to the accompanying drawings, wherein:

FIG. 1 shows a unidirectional airflow ventilating shoe and the position, shape and structure of a unidirectional airflow ventilating layer inside the shoe.

FIG. 2 illustrates the position and the shape of the compressible cavity, the main airflow passage, the branches, air inlet and air outlets.

FIG. 3 is the back view of the unidirectional airflow ventilating layer which shows the cavity and the air inlet in the heel portion of the shoe.

FIG. 4 illustrates the first action of the step a wearer takes. When the heel portion of the shoe touches the ground, the air inlet of the unidirectional airflow ventilating shoes will be closed under pressure.

Figure 5:
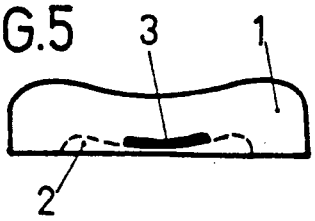
FIG. 5 is the back view of the ventilating layer in which the air inlet is in a compressed and closed state.

It can be seen from FIG. 1 that the unidirectional airflow ventilating layer (1) of a unidirectional airflow ventilating shoe is a sole-shaped elastic material consisting a thick heel portion and thin front portion, the bottom surface of the elastic material being pressed closely to the sole (9) of the shoe. As shown in FIG. 2, a cavity (2) is provided in the heel portion.

The cross-section of the cavity is arch-shaped, with the peak point of the arch being about $\frac{3}{4}$ of thickness of the heel portion and the miximum section area of the arch about 4/5 of the section area of the heel portion, thus guaranteeing a certain capacity and mantaining a considerable degree of elasticity. An air inlet (3) is opened up backwardly at the back upper portion of the cavity (2).

As illustrated in FIG. 1, the heel portion has a back wall in which an air inlet (3) opening to the rear area of the shoe resides in such a manner that when force is applied to the head portion of the layer, the air inlet (3) is closed as a result of the back wall collapsing. The cross-section of air inlet (3) in FIG. 3 is in the shape of a sharp leaf so that it can be completely closed under pressure.

A main airflow passage (4) is opened up from the front of the cavity (2) to the fore sole (FIG. 2). The cross-section of main airflow passage (4) is arch-shaped and the ratio of the height and width is 1:3. The passage is completely closed when bent. As shown in FIG. 2, the main airflow passage (4) is divided into branches (5) at the front end thereof, preferably 2–4 branches. The cross-section of branches (5) are preferably in the shape of semi-circles. A cylindrical air outlet (6) is opened up at the front end of each branch (5) and directed at the root of the toes in the shoe (FIG. 3). The entire layer (1) can be stuck onto the sole of the shoe.

Figure 6:
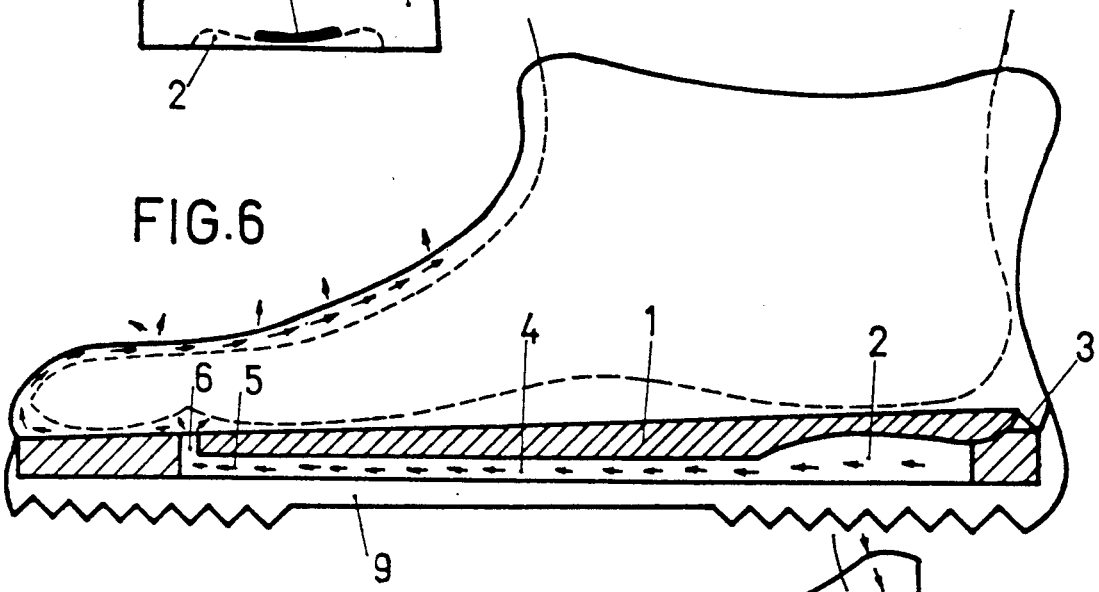
FIG. 6 illustrates the path of circulation and the flowing out of the air inside the cavity and the main airflow passage and the branches thereof when the centre of gravity of the wearer is shifted forward.

While the wearer walks, the heel portion will touches the ground first, as shown in FIG. 4. Air inlet (3), being located at the part which first touches the ground, will be closed under heavy pressure of the wearer as illustrated in FIG. 5. It can be seen from FIG. 6 that with the centre of gravity being shifted forward, the point of the shoe which touches the ground will also be moved forward. In the meantime, cavity (2) is compressed from the back to the front and the air in the cavity is flowing out through main airflow passage (4), branches (5) and air outlet (6) to the front part of the shoe, and then flowing out through the eyelet, the gaps between the tongue and the edge of the shoe's upper.

When the heel portion is lifted and the fore sole touches the ground, the shoe is bent. That will cause main passage (4) to be bent and closed. In this way, air in the fore part is hindered from going back into cavity (2) and therefore the air only goes in one direction.

Figure 7:
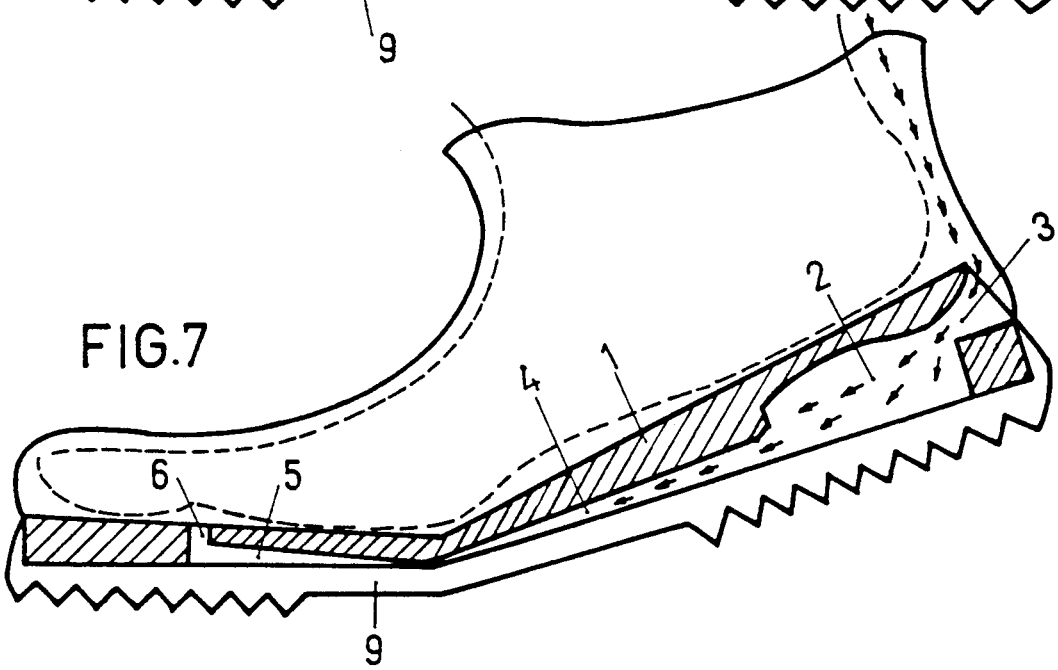
FIG. 7 illustrates the last action of the step taken by the wearer. When the heel portion of the shoe is lifted and the front part of the shoe touches the ground, the main airflow passage will be at a folded and closed state and fresh air is sucked through the air inlet into the cavity of the layer.

Concurrently, air inlet (3) is elastically opened. The fresh air outside is sucked into cavity (2) through the gap between edge of shoe's upper and the foot heel (FIG. 7). As a result, a process of unidirectional airflow ventilating is accomplished in every step the wearer takes.

Figure 8:
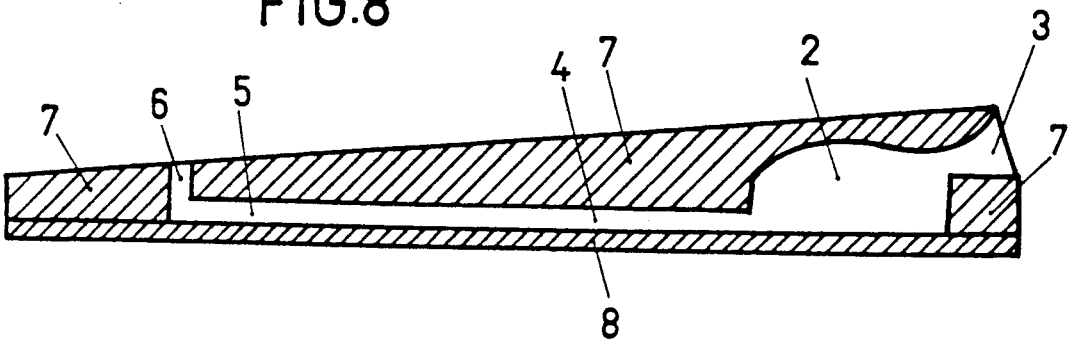
FIG. 8 is a cross-section view illustrating the shape and structure of a unidirectional airflow ventilating insole of the present invention for shoes.

For convenience sake, this invention also provides a undirectional airflow ventilating insole comprising upper insole (7) and lower insole (8), as shown in FIG. 8. The structure of upper insole (7) is the same that of ventilating layer (1) of said unidirectional airflow ventilating shoes. Cavity (2), air inlet (3), main airflow passage (4), airflow branches (5) and air outlet (6) are provided in a piece of elastic material. Lower insole (8) can either form an entirety with upper insole (7), or be an elastic substrate in the form of a sole closely sealed to the bottom surface of the upper insole.

A pair of unidirectional airflow ventilating shoes can be made without increasing material cost by replacing the middle soles of such soft-sole shoes as ordinary walking shoes and sport shoes with the unidirectional airflow ventilating insole. In applying the ventilating insole to boots, an air channel provided at the upper of each boot and connected with the air inlet of the ventilating insole is enough to change a ordinary boot to a unidirectional airflow ventilating boot. Using the ventilating insole in any kind of shoes can attain the same result as unidirectional airflow ventilating shoes.

The present invention has several distinctive advantages. For example high rate of ventilating can be accomplished by fresh air outside shoes unidirectionally flowing into the front part, which is the dampest and hottest part inside the shoe, so that the wearer can feel wind blowing towards his feet. This feature also helps prevent stink and disease of feet. Besides, since the material used is cheap and the structure is simple, the manufacturing process is convenient and the production cost is low. As no pump body or valve is required, such kind of shoes are comfortable to wear and the insole is suitable to be used with shoes of all classes, regardless of the materials used for the vamp and sole, the thickness of the heel and the height of the upper part of the shoes.

A further merit of the invention is that people suffering from foot disease may spray medical lotion frequently into the unidirectional airflow ventilating layer of the shoe or the cavity and airflow passage of the ventilating insole. As a result, the medical lotion would be blown to the fore part of the feet while the wearer walks. Furthermore, perfume may also be sprayed into the cavity and passage so as to prevent the feet from stinking.

Two specific embodiments are described hereunder:

The first embodiment is a unidirectional airflow ventilating shoe.

A 30 mm thick PVC (polyvinyl ehloride) or PU (polyurethane) piece is cut into the shape of a sole with the front part cut to 8 mm thick and the longitudinal section being in the form of a right-angled trapezium. A arched cavity is excavated at the heel part with the thickest part is 22 mm. The external edge of the cavity has 8 mm wide allowances and the capacity of the cavity is approximately 6000 $mm^3$. A arch-shaped main airflow passage excavated at the front of the cavity is 3 mm tall and 12 mm wide and is divided into at least two branches as it reaches the front sole; each of said branches is 3 mm tall and 6 mm wide. Cylindrical air outlets which have diameters of 6 mm are vertically excavated at the front end of each branch, penetrating the piece. Air inlet with tapered leaf-shaped cross-section which are 18 mm wide and 5 mm tall is excavated at the rear upper part of the cavity. The air inlet penetrate backwards the piece. Taking out the middle sole and inner lining cloths of a readymade sports shoe with low upper, applying adhesives all over the sole of the shoe and sticking the excavated surface of the above manufactured piece on the sole, than a unidirectional airflow ventilating shoe will be formed. An experiment shows that about 5000 $mm^3$ fresh air is blown out of the outlets with each step the wearer takes.

The second embodiment is a unidirectional airflow ventilating insole for shoes.

A 20 mm thick synthetic rubber piece is used as a upper insole. The same processing technique used in the first embodiment is employed. Since the elasticity of rubber is stronger, the thickness of the synthetic rubber can be thinner. The front part is cut to 6 mm thick and the capacity of the cavity is about 4000 $mm^3$. The arch-shaped main airflow passage is 2 mm tall and 12 mm wide; each of branches is 2 mm tall and 6 mm wide. The sharp leaf-shaped air inlets is 18 mm wide and 3.5 mm tall. The air outlets are cylindrical which have diameters of 6 mm. Using 1.5 mm thick soft plastic pieces as a lower insole and adhering the lower insole tightly to the excavated surface of the upper insole with adhesives, then a unidirectional airflow ventilating insole is formed. The ventilating insole can be used in any kind of shoes and about 3000 $mm^3$ fresh air is blown out of the air outlets with each step while walking.

The above embodiments are only examples for describing the present invention. They should not have any limitations on this invention, i.e. simple improvements or alterations made by persons skilled in the art within the scope defined by the claims should be understood as not going beyond the scope of the invention. For instance, alterations can be made on the sizes of the cavity, the main airflow passage, the branches and the air outlets of the unidirectional airflow ventilating shoes or the ventilating insole corresponding to the sizes of various kinds of shoes. The numbers of branches and air outlets can also be increased or reduced, etc.

I claim:

1. A unidirectional airflow ventilating shoe comprising an upper part, a sole, and a unidirectional airflow ventilating layer provided inside the shoe on the sole, wherein the ventilating layer having a heel portion and a fore part and including a compressible cavity at the bottom surface in the heel portion of the layer; said heel portion having a substantially vertical back wall portion in which an air inlet opening to the rear area of the shoe resides in such a manner that when force is applied to the heel portion of the layer, the air inlet is closed as a result of the back wall collapsing; and an elastic main airflow passage at the front of the cavity leading to the fore part of the layer, the fore end of the main airflow passage being divided into a plurality of branches, the fore end of each branch being provided with an air outlet leading to the upper surface of the layer.

2. The ventilating shoe according to claim 1, wherein the cavity is arch-shaped and the cross section of the air inlet has the shape of a sharp leaf.

3. The ventilating show according to claim 1, wherein the cross section of the main airflow passage is arch-shaped, which is completely closed when the ventilating layer is bent.

4. The ventilating shoe according to claim 1, wherein the number of branches in one of 2, 3 and 4 and the cross section of each branch is in the shape of a semi-circle.

5. The ventilating shoe according to claim 1, wherein the cross section of each air outlet is cylindrical.

6. A unidirectional airflow ventilating insole for shoes, comprising an upper layer and a lower layer, a heel portion and a fore part, the upper layer having a compressible cavity in the heel portion of the insole; said heel portion having a substantially vertical back wall portion connecting the upper and low layers, in which back wall portion an air inlet opening to the rear area of the shoe resides in such a manner that when force is applied to the heel portion of the upper portion, the air inlet is closed as a result of the back wall collapsing; and an elastic main airflow passage at the front of the cavity leading to the fore part of the insole, the fore end of the main airflow passage being divided into a plurality of branches, the fore end of each branch being provided with an air outlet leading to the upper surface of the insole, the lower layer being an elastic sole-shaped plane bottom of the insole.

7. The ventilating insole according to claim 6, wherein the cavity is arch-shaped and the cross section of the air inlet has the shape of a sharp leaf.

8. The ventilating insole according to claim 6, wherein the cross section of the main airflow passage is arch-shaped, which is completely closed when the insole is bent.

9. The ventilating insole according to claim 6, wherein the branches is one of 2, 3 and 4 the cross section of each branch being in the shape of a semi-circle.

10. The ventilating insole according to claim 6, wherein the cross section of each outlet is cylindrical.

11. The ventilating insole according to claim 6, wherein the lower portion of the insole is separated from the upper portion, which is an elastic substrate in the shape of the sole and is adhered to the bottom surface of the upper portion of the insole with adhesives.

* * * * *